US010912978B2

(12) United States Patent
Bortolotto

(10) Patent No.: US 10,912,978 B2
(45) Date of Patent: Feb. 9, 2021

(54) PUNCHING BAG WITH SPINE FOR SUSPENSION

(71) Applicant: ITATAMI SRL, Montebelluna (IT)

(72) Inventor: Guido Bortolotto, Refrontolo (IT)

(73) Assignee: ITATAMI SRL, Montebelluna (IT)

( * ) Notice: Subject to any disclaimer, the term of this patent is extended or adjusted under 35 U.S.C. 154(b) by 0 days.

(21) Appl. No.: 16/348,700

(22) PCT Filed: Nov. 7, 2017

(86) PCT No.: PCT/IT2017/000245
§ 371 (c)(1),
(2) Date: May 9, 2019

(87) PCT Pub. No.: WO2018/087791
PCT Pub. Date: May 17, 2018

(65) Prior Publication Data

US 2019/0282880 A1 Sep. 19, 2019

(30) Foreign Application Priority Data

Nov. 10, 2016 (IT) ..... 102016000113127

(51) Int. Cl.
*A63B 69/20* (2006.01)
*A63B 69/24* (2006.01)

(52) U.S. Cl.
CPC ..... *A63B 69/201* (2013.01); *A63B 69/24* (2013.01); *A63B 2209/00* (2013.01)

(58) Field of Classification Search
CPC ..... A63B 2209/00; A63B 69/20–325
See application file for complete search history.

(56) References Cited

U.S. PATENT DOCUMENTS 2,197,545 A * 4/1940 Bachman ..... A63B 69/345 473/444
3,416,795 A * 12/1968 Lewis ..... A63B 69/345 473/444

(Continued)

FOREIGN PATENT DOCUMENTS

CA 2685863 A1 5/2011
CN 204034226 U 12/2014

(Continued)

*Primary Examiner* — Nyca T Nguyen
(74) *Attorney, Agent, or Firm* — Volpe Koenig

(57) ABSTRACT

Bag for punches, kicks and boxing, provided with spine, for suspension, consisting of a part of containment, preferably cylindrical, provided throughout its central vertical axis, of a cylinders assembly, made of concrete, having also different dimensions and specific weights, separated from each other, by expanded polyurethane agglomerated disks, wherein, both of said cylinders and disks, are also centrally perforated, to allow the passage inside them, of a chain or of a cable, both of metal, in order to assemble said cylinders and disks, in a vertically layered manner, as a spine, coated by a layer of expanded polyurethane agglomerate foam, obtained by means of a hollow cylinder and, alternatively, by a sheet layer wrapped around the said spine, in the manner of the spine of a human being, wrapped in connective tissue and muscles, to simulate the areas of the head, neck, chest and abdomen of the opponent.

4 Claims, 5 Drawing Sheets

(56) References Cited

U.S. PATENT DOCUMENTS 5,437,590 A * 8/1995 D'Alto ..... A63B 69/208 473/441
5,863,278 A * 1/1999 Chen ..... A63B 69/20 482/83
6,090,018 A * 7/2000 Laudenslager ..... A63B 69/201 482/83
7,758,476 B2 * 7/2010 Chu ..... A63B 69/004 482/83
8,602,944 B2 * 12/2013 Fleitz ..... A63B 69/004 482/8
10,350,474 B1 * 7/2019 Magrino ..... A63B 21/0606
2004/0009852 A1 1/2004 Chen
2004/0097348 A1 * 5/2004 Laudenslager ..... A63B 69/201 482/86
2007/0099772 A1 5/2007 Fu et al.
2008/0188360 A1 * 8/2008 Chu ..... A63B 69/201 482/83
2009/0176635 A1 * 7/2009 Brinson ..... A61H 23/0263 482/141
2009/0318272 A1 12/2009 Evans
2011/0111928 A1 * 5/2011 Tsakiris ..... A63B 69/201 482/87
2011/0237404 A1 * 9/2011 Smith ..... A63B 69/201 482/83
2012/0149534 A1 * 6/2012 Fu ..... A63B 69/201 482/90
2014/0206504 A1 * 7/2014 Barreras ..... A63B 69/201 482/8
2014/0226919 A1 8/2014 Fu et al.
2014/0274588 A1 * 9/2014 Nelson ..... A63B 69/20 482/90
2014/0329044 A1 * 11/2014 Fantin ..... B32B 3/18 428/71
2015/0011365 A1 * 1/2015 Nelson ..... A63B 69/20 482/84
2015/0126339 A1 * 5/2015 Thomas ..... A63B 69/004 482/83
2015/0273306 A1 10/2015 Fu
2015/0352423 A1 12/2015 Almeras
2016/0059102 A1 * 3/2016 Williamson ..... A63B 69/201 482/8
2016/0136500 A1 * 5/2016 Powell ..... A63B 69/205 482/89
2019/0282880 A1 * 9/2019 Bortolotto ..... A63B 69/201

FOREIGN PATENT DOCUMENTS

FR 3001395 A1 8/2014
TW 200930437 A 7/2009
WO 2010016048 A1 2/2010
WO 2010076541 A2 7/2010

* cited by examiner

PUNCHING BAG WITH SPINE FOR SUSPENSION

The present invention relates to a bag for punches, kicks and boxing, provided with spine, for suspension, consisting of a part of containment, preferably cylindrical, provided throughout its central vertical axis, of a cylinders assembly, made of concrete, having also different dimensions and specific weights, in turn separated from each other by expanded polyurethane agglomerated foam disks, wherein, both of said cylinders and disks, are also centrally perforated, to allow the passage inside them, of a chain or of a cable, both of metal, in order to assemble said cylinders and disks, in a vertically layered manner, as a spine, coated by a layer of expanded polyurethane agglomerate foam, obtained by means of a hollow cylinder and, alternatively, by a plate wrapped around the said spine like a spine of a human being, wrapped in connective tissue and muscles, to simulate the areas of the head, neck, chest and abdomen of the human opponent.

FIELD OF APPLICATION

In the field of fighting disciplines, by means of punches, kicks and other parts used of a human body, for said fighting disciplines for sports and not, the training, is largely done by means of suspended mechanical assemblies, inert and not, known as bags for punches, kicks and boxing, made to absorb the blow of a human punch or kick. The bags for punches, kicks and boxing, are at present, conventionally made, by making a sack or container of cylindrical shape, having different heights, diameters and weights, constituted by said outer container, of cylindrical shape, which is either filled with sand, that also with water and gas, in order to both absorb the punch or stroke of the person in training, as to return, by rebound, a response similar to that of an opposing human body, when struck.

According to the prior art, said bags for punches, kicking and boxing, are usually suspended, by means of a series of chains attached to the upper side of said bags, which then all join to a single chain, which is attached to the ceiling of the area or gymnasium where these trainings are practiced. This type of suspension allows the said bag for punching, kicking and boxing, to swing freely, as a result of the hits sustained by the person in training, thing that from what established, it occurs both in a non predictable manner, that not at least equal, to that of a real opponent.

Another known fact of bags for punches or boxing typical of the ones realized by the present state of the art, is the filling material, which in the case of sand, though sometimes embedded with rags of materials, such as cotton and synthetic fabrics, under the effect of the punches and kicks suffered, it tends to fall to the bottom of the container bag, due to the force of gravity, deforming the bag like a basin, thus plunging the upper part. Also, in the case of filling with sand, the return of the latter, following the punch or kick suffered, is not immediate and, the impact of the punch of the person in training gets more resistance, than the one that would offer the human body of an opponent.

A further known fact of the bags for punches, kicks or boxing, typical of those made by the present state of the art, is the filling material which, in the case of water or other fluids, introduced as filling in the said bags for punches, kicks or boxing, due to the deformability of said fluids, under the effect of the punches and kicks suffered, it finds escape and space in other parts of said bags, thereby deforming the shape thereof. In the case of said fluid-filled bags, the return of the latter is not just practically immediate but, also causes an internal rebound motion, causing the bag, to do again non-natural movements for a proper simulation of a human body such as the ones of an opponent. Water also shows a stiffness to punches and kicks, bigger and different, than that of a real human body.

STATE OF THE ART

A brief research in the field of literature, also of patents, although not in-depth, allowed to identify at least the following prior documents:

D1) US2009318272 (A1) EVANS BRAD LESLIE [US]
D2) US2004009852 (A1) CHEN SHERRY [TW]
D3) US2007099772 (A1) FU DAVID [TW]
D4) CA2685863 (A1) LEMAIGRE GORDON C [CA]
D5) US2015273306 (A1) FU TUNG-CHIEN [TW]
D6) US2014226919 (A1) FU DICKSON [TW]
D7) WO2010076541 (A2) SAVARY JEAN-RENE [FR]
D8) TW200930437 (A) WILLIAMS STEPHEN PERRIN [NZ]

D1 describes an articulated coordination punching bag that includes: a flexible central core; a first target enclosing a first portion of the central core; and a second target enclosing a second portion of the central core. The first and second targets may move independently of each other.

D2 describes a punching bag that includes a chamber for receiving a soft or resilient barrel, and a container received in the barrel and having a chamber for selectively receiving insert materials therein. The container includes one or more rings disposed on top for hanging purposes. The container includes a port for filling the insert materials into the container. The rings may be solidly disposed on top of the container for solidly hanging the punching bag to any support frames or members. The bag includes an upper cover having one or more orifices for receiving the rings.

D3 describes an adjustable punching bag that includes an outer jacket bag and an inner bag set received in the outer bag. The inner bag set contains core stuffing, in which the content and kind of the stuffing can be adjusted to change the weight of the entire punching bag for meeting different practicing needs of users. Further, it is convenient to pack, store all parts thereof to lower delivery cost.

D4 describes an air punching bag that consists of air bladder, 70 lb. sand bag, outer bag, stiff foam, intake valve grommet. Air bladder is made out of rubber. Same rubber as bicycle tires. Sand bag is made out of synthetic leather. Outer bag is made out of synthetic leather. Grommet around the top part of the outer bag for hanging. Air bladder has an air intake valve on top. Air bladder has an opening through the center for the sand bag. I pump air bladder with enough air to get it to stand on it own. I place the air bladder in the outer bag. I put the foot foam in through the center of the air bladder right to the bottom. I put the 70 lb. sand bag inside the air bladder. I pump air into the air bladder via the air intake valve until thee air punching bag is good for punching. I stitch the rope through the grommet on the outer bag and I hang the air punching bag on the punching bag rack.

D5 describes a multi-training function air-water punching bag structure that comprises one inner bladder, one external bag, at least one set of handles, at least two sets of first suspenders, and at least one set of second suspenders. The inner bladder respectively contains liquid and air simultaneously. Users can adjust the volume of the liquid and air according to the needs of training and the tactile feel of the punches. The external bag integrates the handle set or the first set of suspenders and the second set of suspenders to reach the effect of multi-training functions.

D6 describes an extra-long air-water sandbag which comprises one inner bladder and one external bag. Wherein, said external bag is the bag to hold the said inner bladder and covers the external of the said inner bladder. The said inner bladder further comprises one inner and outer layer container set and at least one separation layer gas container. The inner and outer layer container set further comprises one gas container and one liquid container. The said gas container is a bladder for gas storage placed in inner compartment of said inner and outer layer container set. The said liquid container is a bladder for liquid storage placed in outer compartment of said gas container. Or, the said gas container is a bladder for gas storage placed in outer compartment of said inner and outer layer container set; and the said liquid container is a bladder for liquid storage placed in inner compartment of said gas container. The said extension layer gas container is a bladder for containing gas and housed at the top, bottom or top and bottom of the said inner and outer layer container set and fixedly connect or couple to the top, bottom or top and bottom of the said inner and outer layer container set to increase the total length of space of gas container of the punching bag. As the length of gas container is increased, combat training for the feet can be hence achieved.

D7 describes a hitting equipment for training and practicing combat sports, which is shaped like a punching bag including a body made of a flexible casing and an inner space containing a filling means. In the punching bag according to the invention: the inner space is hermetically sealed and defined by an airtight, flexible inner surface; the filling means consists of a ballast product and a pressurised gas filling said inner space; and the flexible casing is provided with a means for accessing said inner space, which can be hermetically sealed and which enables the insertion and/or the removal of said filling means into/from to said inner space. Further, the casing is made up of a plurality of parts made of a heat-weldable plastic material connected together in a sealed fashion, namely a top disk and a bottom disk connected by a tubular portion. The hanging means includes straps each of which is rigidly connected to a heat-weldable plastic part attached to said casing.

D8 describes a punching bag, which comprises a hollow inner bladder, a hollow outer envelop enclosing an outer surface of the inner bladder, a plurality of hanging bands, and two lids respectively mounted to opposite ends of the inner bladder. The inner bladder has a top and a bottom and an interior receiving stuffing therein and forms a plurality of band receiving slots at least in an edge thereof adjacent to the top. The hanging bands correspond in number to the band receiving slots. Each hanging band has an end extending through the respective band receiving slot deeply to the bottom of the inner bladder to be fixed by sewing to an inside surface of the inner bladder. An opposite end of each hanging band projects beyond the top of the inner bladder. Thus, the hanging band possesses a wide range of fixing by sewing so that the hanging band is extremely firmly fixed to the inner bladder to enhance the stability and lifespan of the punching bag.

Ultimately it is therefore reasonable to consider known:

an articulated coordination punching bag that includes: a flexible central core; a first target enclosing a first portion of the central core; and a second target enclosing a second portion of the central core. The first and second targets may move independently of each other;

a punching bag that includes a chamber for receiving a soft or resilient barrel, and a container received in the barrel and having a chamber for selectively receiving insert materials therein. The container includes one or more rings disposed on top for hanging purposes. The container includes a port for filling the insert materials into the container. The rings may be solidly disposed on top of the container for solidly hanging the punching bag to any support frames or members. The bag includes an upper cover having one or more orifices for receiving the rings;

an adjustable punching bag that includes an outer jacket bag and an inner bag set received in the outer bag. The inner bag set contains core stuffing, in which the content and kind of the stuffing can be adjusted to change the weight of the entire punching bag for meeting different practicing needs of users. Further, it is convenient to pack, store all parts thereof to lower delivery cost;

an air punching bag that consists of air bladder, 70 lb. sand bag, outer bag, stiff foam, intake valve grommet. Air bladder is made out of rubber. Same rubber as bicycle tires. Sand bag is made out of synthetic leather. Outer bag is made out of synthetic leather. Grommet around the top part of the outer bag for hanging. Air bladder has an air intake valve on top. Air bladder has an opening through the center for the sand bag. I pump air bladder with enough air to get it to stand on it own. I place the air bladder in the outer bag. I put the foot foam in through the center of the air bladder right to the bottom. I put the 70 lb. sand bag inside the air bladder. I pump air into the air bladder via the air intake valve until the air punching bag is good for punching. I stitch the rope through the grommet on the outer bag and I hang the air punching bag on the punching bag rack;

a multi-training function air-water punching bag structure that comprises one inner bladder, one external bag, at least one set of handles, at least two sets of first suspenders, and at least one set of second suspenders. The inner bladder respectively contains liquid and air simultaneously. Users can adjust the volume of the liquid and air according to the needs of training and the tactile feel of the punches. The external bag integrates the handle set or the first set of suspenders and the second set of suspenders to reach the effect of multi-training functions;

an extra-long air-water sandbag which comprises one inner bladder and one external bag. Wherein, said external bag is the bag to hold the said inner bladder and covers the external of the said inner bladder. The said inner bladder further comprises one inner and outer layer container set and at least one separation layer gas container. The inner and outer layer container set further comprises one gas container and one liquid container. The said gas container is a bladder for gas storage placed in inner compartment of said inner and outer layer container set. The said liquid container is a bladder for liquid storage placed in outer compartment of said gas container. Or, the said gas container is a bladder for gas storage placed in outer compartment of said inner and outer layer container set; and the said liquid container is a bladder for liquid storage placed in inner compartment of said gas container. The said extension layer gas container is a bladder for containing gas and housed at the top, bottom or top and bottom of the said inner and outer layer container set and fixedly connect or couple to the top, bottom or top and bottom of the said inner and outer layer container set to increase the total length of space of gas container of the punching bag. As the length of gas container is increased, combat training for the feet can be hence achieved;

a hitting equipment for training and practicing combat sports, which is shaped like a punching bag including a body made of a flexible casing and an inner space containing a filling means. In the punching bag according to the invention: the inner space is hermetically sealed and defined by an airtight, flexible inner surface; the filling means consists of a ballast product and a pressurised gas filling said inner space; and the flexible casing is provided with a means for accessing said inner space, which can be hermetically sealed and which enables the insertion and/or the removal of said filling means into/from to said inner space. Further, the casing is made up of a plurality of parts made of a heat-weldable plastic material connected together in a sealed fashion, namely a top disk and a bottom disk connected by a tubular portion. The hanging means includes straps each of which is rigidly connected to a heat-weldable plastic part attached to said casing;

a punching bag, which comprises a hollow inner bladder, a hollow outer envelop enclosing an outer surface of the inner bladder, a plurality of hanging bands, and two lids respectively mounted to opposite ends of the inner bladder. The inner bladder has a top and a bottom and an interior receiving stuffing therein and forms a plurality of band receiving slots at least in an edge thereof adjacent to the top. The hanging bands correspond in number to the band receiving slots. Each hanging band has an end extending through the respective band receiving slot deeply to the bottom of the inner bladder to be fixed by sewing to an inside surface of the inner bladder. An opposite end of each hanging band projects beyond the top of the inner bladder. Thus, the hanging band possesses a wide range of fixing by sewing so that the hanging band is extremely firmly fixed to the inner bladder to enhance the stability and lifespan of the punching bag.

Drawbacks

On the line of principles, some critical and common points, can be identified with reference to known solutions. Observing what is described in D1, the invention closest to the present invention, is noted first of all, the unpredictability of the excursions of the various "targets", inasmuch, true is they are all bound by a single rope, by means of knots, made to bind them at a fixed distance between them but, from the depicted drawings, no independent movements are highlighted, rather indeed, the dynamics of movement of each individual "target" are "forced" by the stricken "target", nearest one, representing more so a risk to the safety of the person in training, inasmuch, the said person, could be hit, by the fast and unpredictable bounce direction, of the other "targets". Another invention closest to the suspension by means of a single-chain, it is found in D2, wherein however, the whole weight of said invention, lies on the said single suspension ring of hooking of the single suspension, which ring suspends, from the top of the said bag, also the bag itself, certainly causing, in time, at least deformity of the shape of the said bag, wherein instead, in the present invention, when the bag is suspended by a single metal chain or cable, said suspension means, cross the entire midline of the center of the said bag and, are firmly anchored to the base of the said bag, by doing so, supporting with absolute safety and longevity, the whole assembly of the bag. Regarding the "fidelity" of reproduction of the mass of a human body, represented by the inventions of the state of the art, it shows that none of them, is capable of returning the same feeling that would give the body of an opponent in combat, inasmuch, although the human body is made up of about 65% water, the other components that represent 35%, are very variable, depending on the muscular state and, fitness of the person in combat. The use of air, gas, and water of what found in the state of the art, does not necessarily equate to the constitution of the human body, nor to the reaction to a punch or a kick suffered, in the various areas of the said body, allowed by the various arts of combat by means of punches, kicks and to other body parts as impact means. During the use of what found in the state of the art described herein, it is more so inevitable that is seen a fast and growing deformation and wear of the bags for punching, kicking and boxing, fact caused in particular due the complexity of construction and, to the various gaps in robustness of the single suspension of the said bags. Consequently, some observed factors that contribute to these important limitations and difficulties, can be, thus, cited individually, even though not necessarily in order of importance, nor exhaustively, as listed below:

- unpredictability of the excursions of the various "targets";
- single suspension, anchored to the summit of the bag, which causes, in time, at least deformity of the shape of the same;
- non "fidelity" in the simulation of the mass of a human body;
- rapid and increasing deformation and wear of the bags for punches, kicks or boxing, this due in particular to the complexity of construction, the use of sands, water, gas, and the various gaps in the robustness of suspension of the said bags.

Considered also these aspects, it is quite evident the need for the sector to identify more efficient solutions, environmentally friendly and cost-effective also from the economic point of view.

BRIEF DESCRIPTION

The present invention describes a bag for punches, kicks and boxing, provided with spine, for suspension, consisting of a part of containment, preferably cylindrical, provided throughout its central vertical axis, of a cylinders assembly, made of concrete, having also different dimensions and specific weights, separated from each other by expanded polyurethane agglomerated disks, wherein, both of said cylinders and disks, are also centrally perforated, to allow the passage inside them, of a chain or of a cable, both of metal, in order to assemble said cylinders and disks, in a vertically layered manner, as a spine, coated by a layer of expanded polyurethane agglomerate foam, obtained by means of a hollow cylinder and, alternatively, by a sheet wrapped around the said spine, in the manner of the spine of a human being, wrapped in connective tissue and muscles, to simulate the areas of the head, neck, chest and abdomen of the opponent.

Aims and Advantages

The above described solution, offers innumerable aims and advantages, which are not to be considered limitative, being further identified in the following, which although not mentioned, must still be included.

A first aim and advantage of the present invention, consists in the manufacture of a bag for punches, kicks and boxing, for suspension, constituted by a containment part, preferably of cylindrical shape, made of leather, synthetic leather or similar plastic material, which can be opened in the top part by means of a zipper, is due to the fact that it is provided, along its entire central vertical axis, of an assembly consisting of at least three hollow cylinders and not, made of concrete, having also different specific weights and dimensions, separated from each other by expanded polyurethane agglomerated foam disks, having also different dimensions and densities, both the said cylinders and disks, vertically assembled as a spine, which is coated with a layer of expanded polyurethane agglomerate foam, made by means of either a hollow cylinder, than by a sheet wrapped around said spine, as the spine of a human being, wrapped in connective and muscular tissues, thus simulating, in such manner, the areas of the head, neck, chest, and abdomen of a human body.

A second aim and advantage of the present invention is that, in a first embodiment of the said suspension of the said bag, the engagement of the said suspension, is carried out by means of a single metal chain and, alternatively, by means of a single metal cable, which are both securely anchored by means of a ring in the shape of a "D", which is then solidly joined, by means of a strap of leather or synthetic leather or similar plastic material, to the bottom part of the said bag and, crosses, on the central vertical axis of the said bag for punches, kicks and boxing, all the cylindrical internal elements of concrete and, all the expanded polyurethane agglomerated foam disks, each having a central hole for the said crossing, to then ultimately exiting from an appropriate hole, located at the center of the top disc of expanded polyurethane agglomerate foam and, of the upper coating, of the said containment part and, said metal chain, or said metal cable, are provided at the top end, of a first snap-hook, hooked to a rotatable means, in turn hooked to a second snap-hook, for the final clamping to the ceiling, wall or other support, for said suspension, in order to allow a free 360° rotation, and also the engagement and release of said bag for punches, kicks or boxing.

A third aim and advantage of the present invention is that, in a second embodiment of the suspension of the said bag, the suspension's hooking is carried out by means of at least four chains, which are fixed to the said bag, by means of snap-hooks, hooked on "D" shaped rings, in turn inserted into special cutouts of leather, synthetic leather or similar plastic material, which are firmly joined also to a reinforcing belt, which is sewn or welded internally at the top of the said bag and, said chains are furthermore joined in their upper end portion, by a first snap-hook, coupled to a swivel means, in turn hooked to a second snap-hook, for engagement with the ceiling support, wall or other type of support for said suspension, in order to allow a free 360° rotation, and also the hooking and release of the said bag for punches, kicks or boxing.

A fourth aim and advantage of the present invention, of a bag for punches, kicks and boxing, for suspension, constituted of an outer containment bag, preferably of cylindrical shape, made of leather, synthetic leather or similar plastic material, realised as a containment bag or lining, openable in the top part by a zipper, is due to the fact that said central spine, is provided with an expanded polyurethane agglomerated foam coat, made of a single cylinder hollow on its central axis, or by a sheet wrapped around said spine, said coatings, having varying dimensions and densities according to the desired weight of the said bag, comparable to those of the connective tissues and muscles of a human body of different sizes, allowing the said bag for punches, kicks and boxing, to absorb the punch blown by the user in training, and reacting similarly to the body of an opponent, engaged in combat arts by means of punches, kicks and boxing.

In conclusion, these aims and advantages, have the noteworthy value, of achieving a bag for punches, kicks and boxing for suspension, in such a way that it is free to rotate on itself at 360°, preferably suspended by a single chain of metal, or a single metal cable, said bag having, in its interior, along the central vertical axis, an assembly consisting of at least three cylinders hollow and not, made of concrete, having also different specific weights and dimensions, vertically separated between them, by expanded polyurethane agglomerated foam disks, having also different dimensions and densities, both of said cylinders and disks, so assembled vertically as a spine, which is coated with a layer of expanded polyurethane agglomerated foam, made either by means of a hollow cylinder, that alternatively, by a sheet, wrapped around the said spine, like the spine of a human being wrapped up by connective and muscular tissues, thereby simulating the human body of an opponent.

These and other aims and advantages will appear in the next detailed description of the embodiments, by means of the accompanying schematic drawings, whose execution details are not intended to be limitative but only and exclusively exemplifying.

DRAWINGS CONTENT

DETAILED DESCRIPTION OF THE INVENTION

Figure 1:
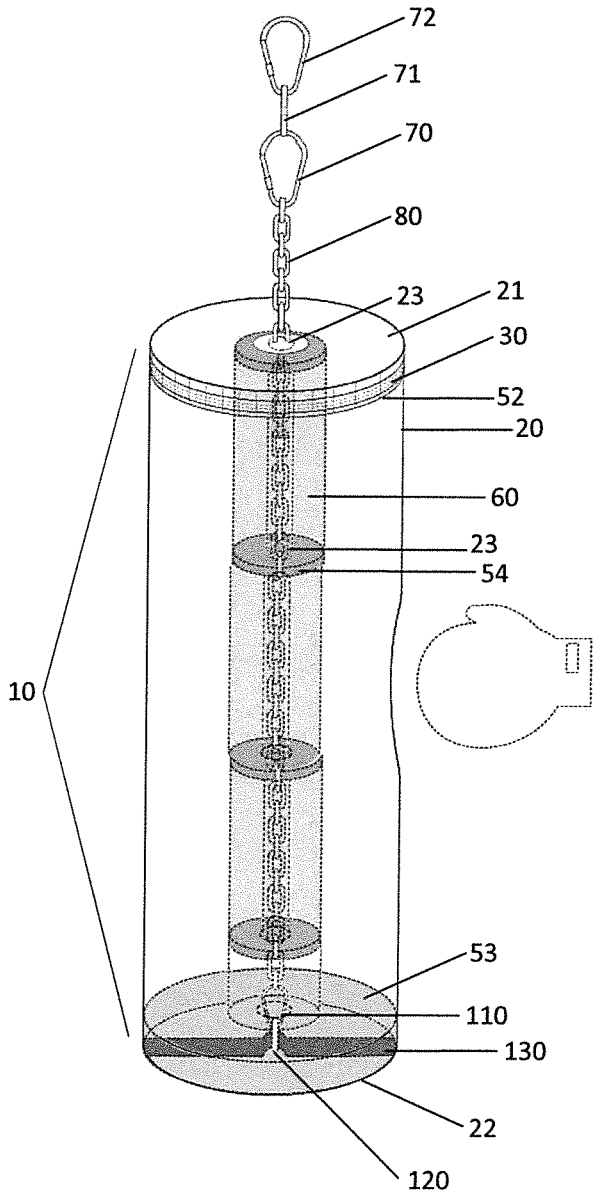
FIG. 1 represents a preferred solution of the present invention, provided with a single suspension by means of a central metal chain and a perforated spine, wherein each constituent part is depicted.
Figure 3:
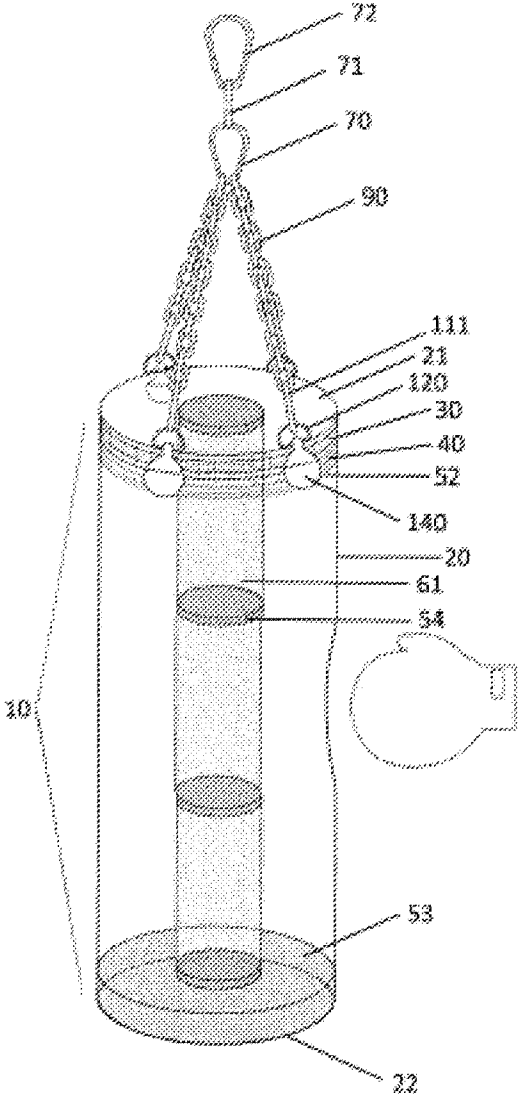
FIG. 3 represents a solution of the present invention, provided with a suspension obtained by at least four metal chains, where each constituent part is depicted.
Figure 2:
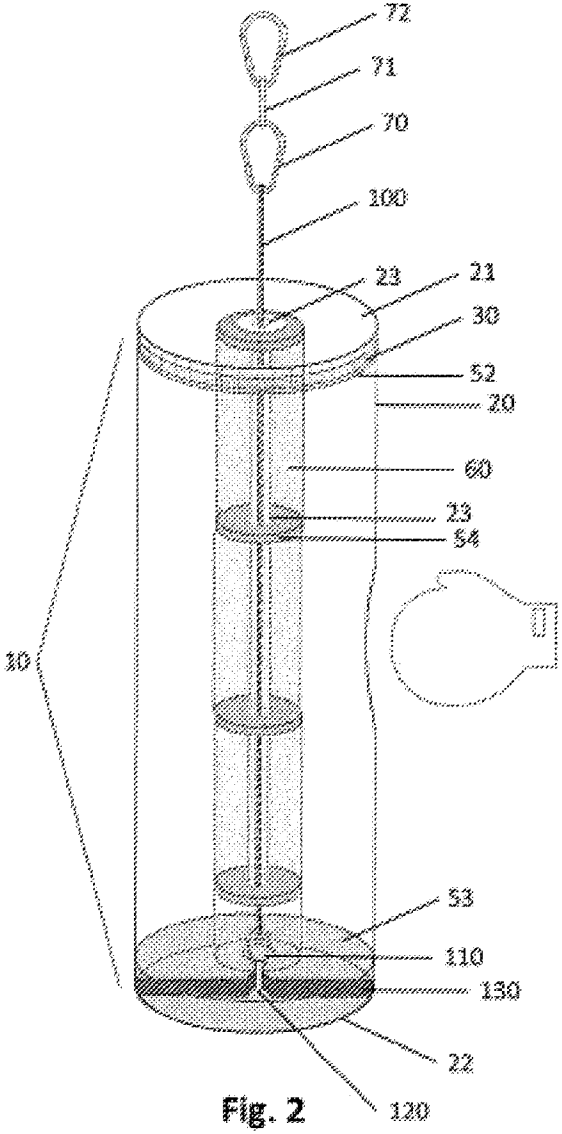
FIG. 2 represents another preferred alternative solution of the present invention, provided with a single central metal cable suspension, where each constituent part is depicted.
Figures 4, 5:
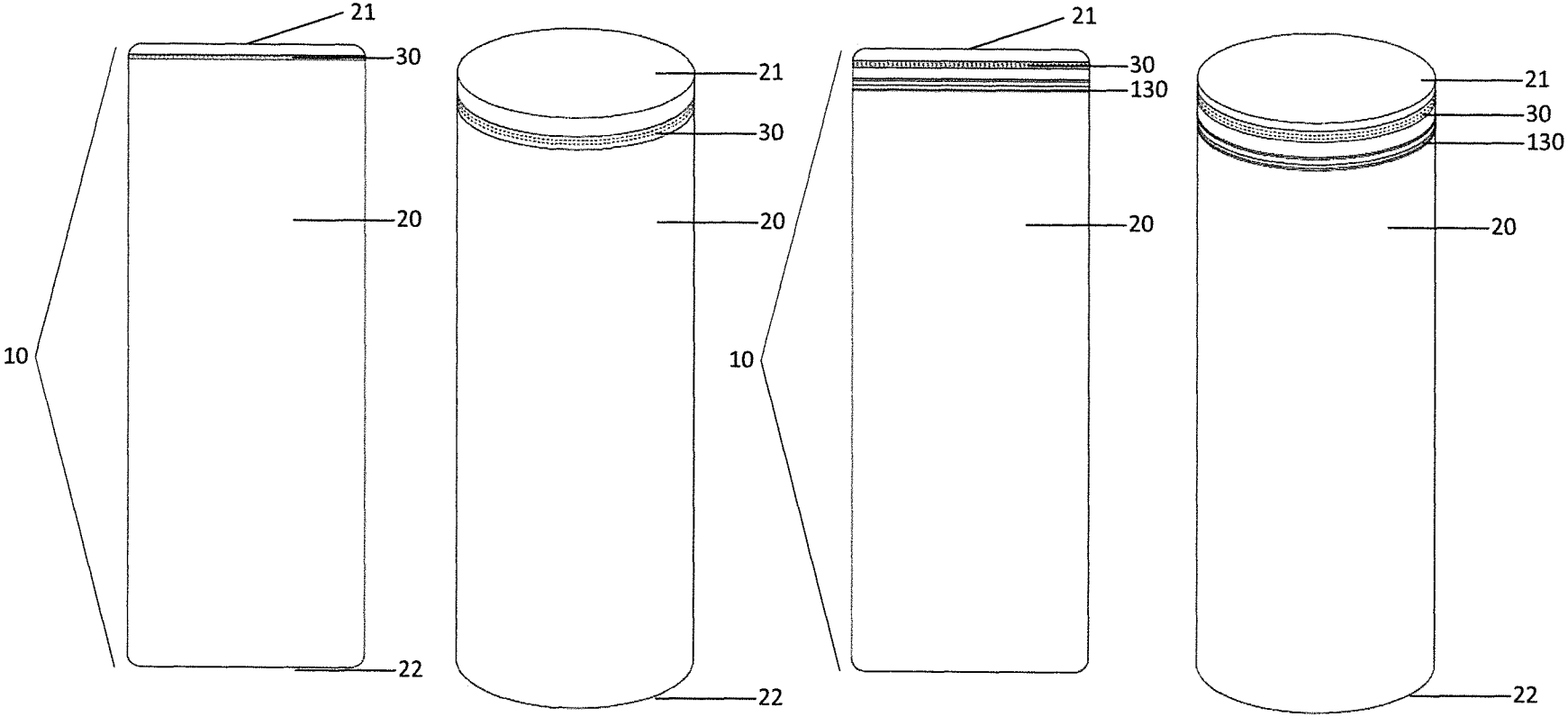
FIG. 4 represents a preferred solution for the containment part of the present invention, suitable for suspension by means of a single rope or metal chain, depicting the zipper closure, provided on the top of the said container bag.
FIG. 5 represents a solution of the present invention, provided with a conventional suspension, by means of at least four metal chains, showing the zipper closure and, reinforcing belt, provided on the top of the said container bag.
Figure 7:
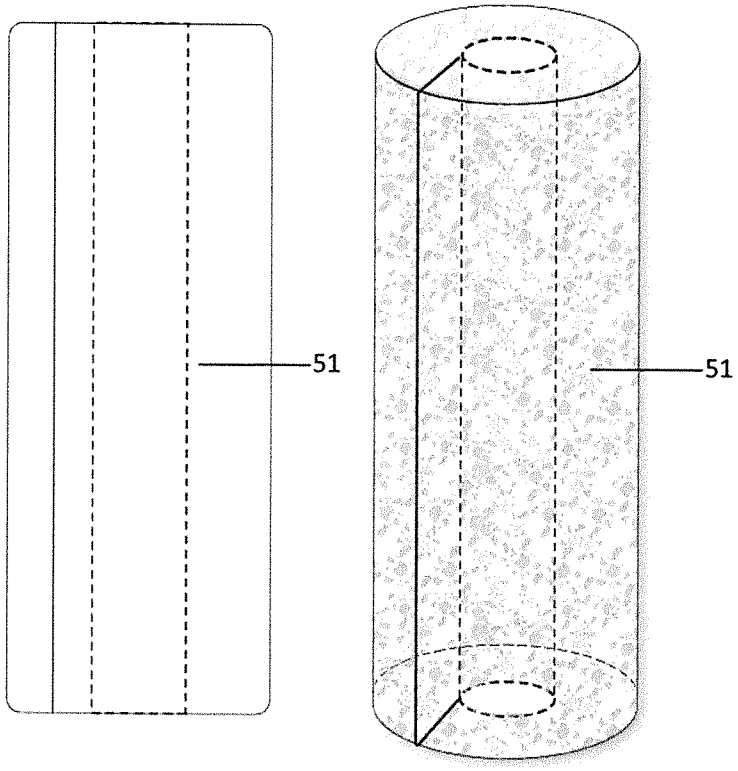
FIG. 7 represents an alternative solution of the present invention, referring to the expanded polyurethane agglomerate foam cylinder, made from a sheet of the said material, wrapped.
Figure 6:
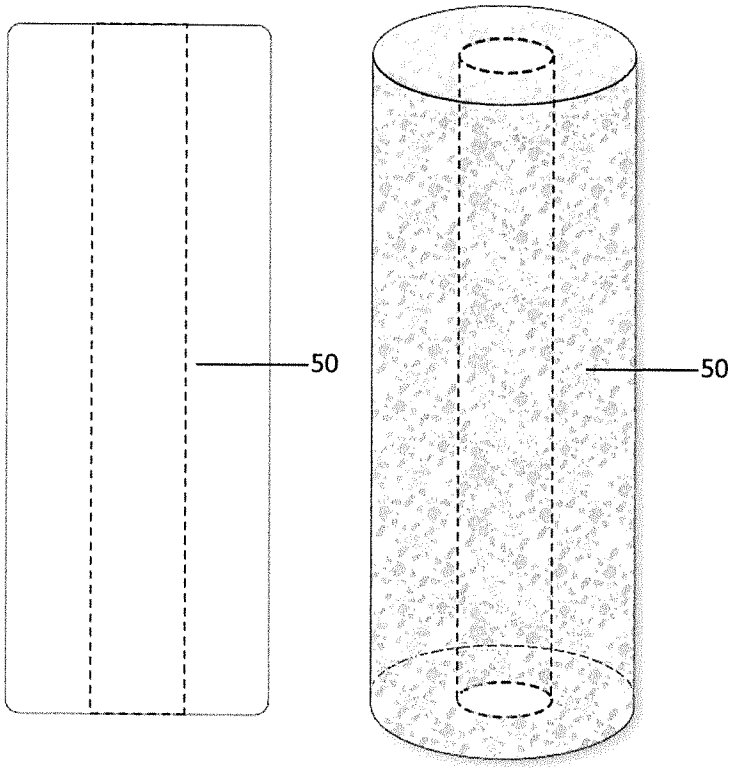
FIG. 6 represents a preferred solution of the present invention, referring to the cylinder of expanded polyurethane foam, hollow all over its central axis, to contain said spine.
Figure 9:
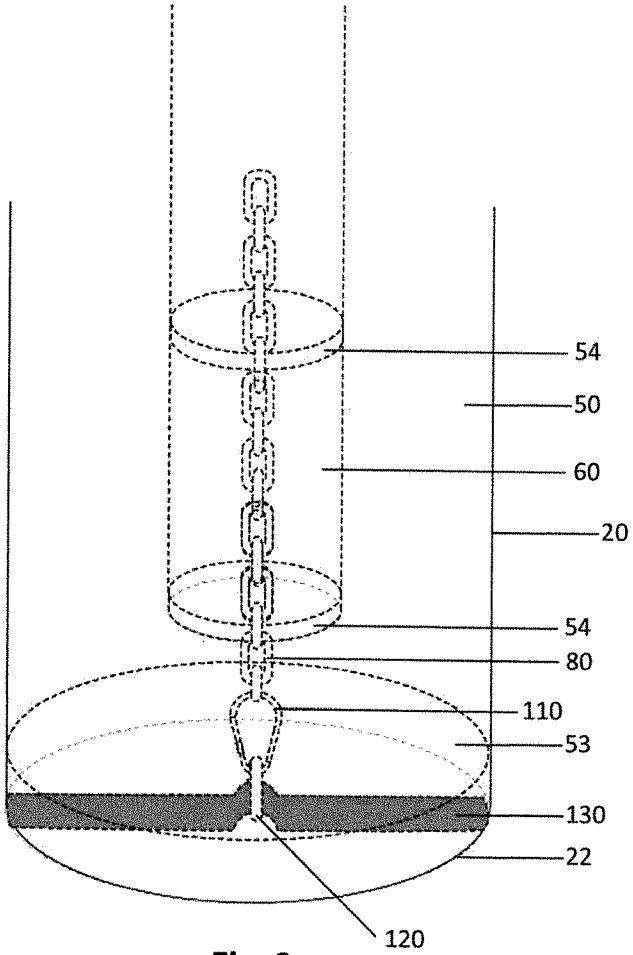
FIG. 9 represents an enlarged and detailed view of the preferred metal cable fastening solution, or of the metal chain fastening solution, at the bottom of the said bag for punches, kicks and boxing, where each constituent part is depicted in an exemplified manner.
Figure 8:
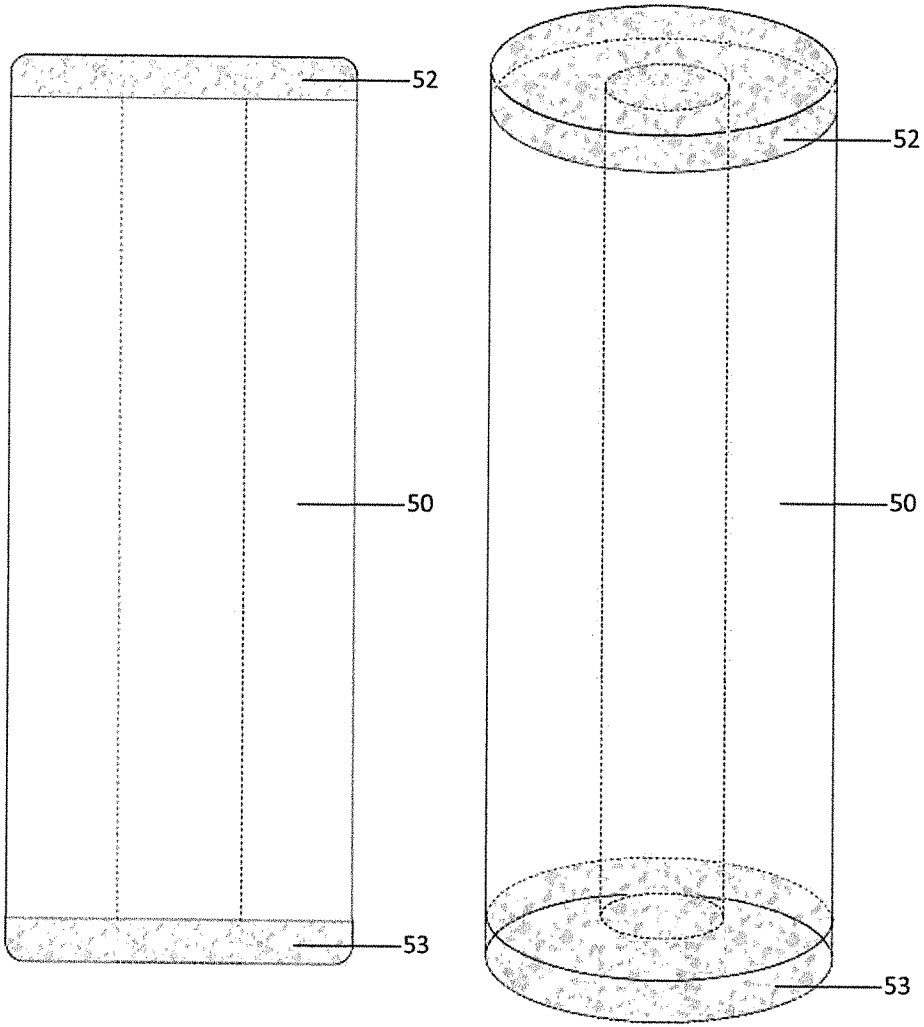
FIG. 8 represents a preferred solution of the present invention, provided with a hollow cylinder, made of expanded polyurethane agglomerated foam, together with the top and bottom disks, made of expanded polyurethane agglomerated foam, which is provided as a cover and bottom, of the inner materials provided in the said bag.

A bag for punches, kicks and boxing (10), for suspension, consisting of a containing part (20), preferably having a cylindrical shape, made of leather, synthetic leather or similar plastic material, in the form of a containing bag or lining, provided with a top part (21), opened by means of a zipper (30) and closed by a bottom part (22), sewn, or welded, to the said containing part (20), wherein, it is provided along its entire central vertical axis, of an assembly composed of at least three hollow cylinders of concrete (60), or, at least three full cylinders of concrete (61), having specific weights of between 800 kg/m$^3$ and 2,600 kg/m$^3$±10%, according to standards UNI EN 206-1/2006, having a diameter of 150 mm±10% and a height of between 100 mm and 200 mm±10%, separated by spacer discs made of agglomerated polyurethane foam (54), having a diameter of 150 mm±10% and a thickness of between 50 mm and 100 mm±10%, having a density of between 60 kg/m$^3$ and 120 kg/m$^3$±10%, according to ISO Standards 845/2006, both said cylinders (60, 61) and discs (54), vertically assembled in the manner of a spine, coated by means of a hollow cylinder of agglomerated polyurethane foam (50) having a diameter of between 300 mm and 600 mm±10% and a height of between 1000 mm and 1800 mm±10%, having a density of between 60 kg/m$^3$ and 180 kg/m$^3$±10%, according to the ISO Standards 845/2006, and alternatively, from an agglomerated polyurethane foam sheet (51) having the same specifications of the said hollow cylinder (50), wrapped around said spine, said coatings (50, 51), the ends of which are provided by a top layer of agglomerated polyurethane foam disc (52) and by a bottom layer of agglomerated polyurethane foam disc (53), both having a diameter of between 300 mm and 600 mm±10% and a thickness of between 30 mm and 120 mm±10%, having a density of between 150 kg/m$^3$ and 240 kg/m$^3$±10%, according to the Standards ISO 845/2006, so as to wrap the said spine in the form of the spinal column of a human being, wrapped by muscle and connective tissues, simulating in this way, a human body of various sizes.

Again a bag for punches, kicks and boxing (10), for suspension, wherein, in a first embodiment of the said suspension of the said bag (10), the engagement of the said suspension, is obtained via a single metal chain (80) and, alternatively, through a single metal cable (100), which are anchored firmly to a bottom hook (110), in turn coupled to a ring in the shape of "D" (120), in turn solidly joined, by means of a strap of leather or synthetic leather or similar plastic material (130), to the lower part (22) of the said bag (10), passing through the central vertical axis of the said bag for punches, kicks and boxing (10), respectively, a hole (23), provided at the center of the bottom agglomerated polyurethane foam disc (53), all the hollow cylinders of concrete (60), all the spacers of agglomerated polyurethane foam discs (54), both provided with a central hole (23), for said passing through, and provided of the said claddings (50, 51), then passing through a hole (23), provided at the center of the top agglomerated polyurethane foam disc (52) and the upper part (21), of the said containing part (20), where the said single metal chain (80), or, the said single metal cable (100), are solidly joined at their upper ends, to a first snap-hook (70), coupled to a swivel means (71), in turn joined to a second snap-hook (72), apt to the hooking at the ceiling support, wall or other type of support, for the said suspension, in order to allow the free rotation at 360° and, the engagement and the release of the said bag for punches, kicks and boxing (10).

Again a bag for punches, kicks and boxing (10), for suspension, wherein, in a second embodiment of the suspension of the said bag (10), the engagement of the said suspension is obtained by means of at least four metal chains (90), which are attached to the said bag (10), by means of at least four snap-hooks (111) coupled to at least four rings in the shape of "D" (120), inserted in at least four leather synthetic leather or similar plastic material offcuts (140), which are firmly joined to a reinforcing belt (40), which is sewn or welded internally to the containing part (20), positioned at the top of the said bag (10) and, the said chains (90) are joined in their upper end, by a first snap-hook (70), coupled to a swivel means (71), in turn coupled to a second snap-hook (72), for the hooking to the ceiling support, wall or other type of support for the said suspension, in order to allow a free 360° rotation, and also the engagement and release of the said bag for punches, kicks and boxing (10).

Always a bag for punches, kicks and boxing (10), for suspension, wherein, the said central spine, is coated by means of a cylinder of a hollow agglomerated polyurethane foam (50), having a diameter of between 300 mm and 600 mm±10% and a height of between 1000 mm and 1800 mm±10%, having a density of between 60 kg/m$^3$ and 180 kg/m$^3$±10%, according to the ISO Standards 845/2006, and alternatively, from a sheet of agglomerated polyurethane foam (51), having the same specifications of the said hollow cylinder (50), wrapped around the said spine, the said coatings (50, 51) made within the said limit of the said specifications, variable accordingly to the desired weight of the said bag (10) and, comparable to those of the connective tissues and muscles of the human body of various sizes, allowing the said bag for punches, kicks and boxing (10), to absorb punches or kicks, struck by the user in training, and react similarly to an opponent human body, of various sizes, engaged in fighting arts by means of punches, kicks and boxing.

REFERENCES (10) bag for punches, kicks and boxing
(20) containing part
(21) top part
(22) bottom part
(23) hole
(30) zipper
(40) reinforcing belt
(50) hollow cylinder of agglomerated polyurethane foam
(51) agglomerated polyurethane foam sheet
(52) top layer of agglomerated polyurethane foam disc
(53) bottom layer of agglomerated polyurethane foam disc
(54) spacer discs made of agglomerated polyurethane foam
(60) hollow cylinders of concrete
(61) full cylinders of concrete
(70) first snap-hook
(71) swivel means
(72) second snap-hook
(80) single metal chain
(90) metal chains
(100) single metal cable
(110) bottom snap-hook
(111) snap-hooks
(120) rings in the shape of "D"

(130) strap of leather or synthetic leather or similar plastic material (140) leather synthetic leather or similar plastic material offcuts

The invention claimed is:

1. A bag for punches, kicks and boxing, for suspension, consisting of a containing part, having a cylindrical shape, made of leather, synthetic leather or plastic material, in the form of a containing bag or lining, provided with a top part, opened by means of a zipper and closed by a bottom part, sewn, or welded, to said containing part, the bag for punches, kicks and boxing is provided along its entire central vertical axis, an assembly composed of at least three hollow cylinders of concrete, or, at least three full cylinders of concrete, having specific weights of between 800 kg/m$^3$ and 2,600 kg/m$^3$±10%, according to standards UNI EN 206-1/2006, having a diameter of 150 mm±10% and a height of between 100 mm and 200 mm±10%, separated by spacer discs made of agglomerated polyurethane foam, having a diameter of 150 mm±10% and a thickness of between 50 mm and 100 mm±10%, and having a density of between 80 kg/m$^3$ and 120 kg/m$^3$±10%, according to ISO Standards 845/2006, both said cylinders and discs, are vertically assembled in the manner of a spine, coated by means of a hollow cylinder of agglomerated polyurethane foam having a diameter of between 300 mm and 600 mm±10%, a height of between 1000 mm and 1800 mm±10%, and having a density of between 60 kg/m$^3$ and 180 kg/m$^3$±10%, according to the Standards ISO 845/2006 or from an agglomerated polyurethane foam sheet having the same diameter, density, and height as said hollow cylinder of agglomerated polyurethane foam, wrapped around said spine, said coatings, having ends which are provided by a top layer of agglomerated polyurethane foam disc and by a bottom layer of agglomerated polyurethane foam disc, both having a diameter of between 300 mm and 600 mm±10%, a thickness of between 30 mm and 120 mm±10%, and having a density of between 150 kg/m$^3$ and 240 kg/m$^3$±10%, according to the Standards ISO 845/2006, so as to wrap said spine such that it is adapted to simulate the spine of a human body of various sizes, wrapped by muscle and connective tissue.

2. The bag for punches, kicks and boxing, for suspension, according to claim 1, consisting of said at least three full cylinders made of concrete, the spaced discs of polyurethane, and the coatings of polyurethane, where the ends of the coatings of said spine are provided in said bag by the top layer of agglomerated polyurethane foam disc, and by the bottom layer of agglomerated polyurethane foam disc, wherein engagement of said suspension, is obtained via a single metal chain or through a single metal cable, which are anchored firmly to a bottom snap-hook, in turn coupled to a D-shaped ring, in turn solidly joined, by means of a strap of leather or synthetic leather or a plastic material, to the bottom part of said bag, passing through the central vertical axis of said bag for punches, kicks and boxing, respectively, a hole, provided at a center of the bottom agglomerated polyurethane foam disc, each of the hollow cylinders of concrete, each of the spacers of agglomerated polyurethane foam discs, are provided with a central hole, for said passing through, said coatings, then passing through said central hole, provided at a center of the top agglomerated polyurethane foam disc and the upper part, of said containing part, where said single metal chain, or, said single metal cable, are solidly joined at upper ends thereof, to a first snap-hook, coupled to a swivel means, in turn joined to a second snap-hook, configured to hook to a ceiling support, wall or other type of support, for said suspension, in order to allow free rotation of 360° and, engagement and release of said bag for punches, kicks and boxing.

3. The bag for punches, kicks and boxing, for suspension, according to claim 1, consisting of said at least three full cylinders made of concrete, the spaced discs of polyurethane, and the coatings of polyurethane, where the ends of the coatings of said spine are provided in said bag by the top layer of agglomerated polyurethane foam disc, and by the bottom layer of said agglomerated polyurethane foam disc wherein engagement of said suspension is obtained by means of at least four metal chains, which are attached to said bag, by means of at least four snap-hooks coupled to at least four D-shaped rings, inserted in at least four leather synthetic leather or plastic material offcuts, which are firmly joined to a reinforcing belt, which is sewn or welded internally to the containing part, positioned at the top of said bag and, said chains are joined in an upper end thereof, by a first snap-hook, coupled to a swivel means, in turn coupled to a second snap-hook, configured to hook to a ceiling support, wall or other type of support for said suspension, in order to allow a free 360° rotation, and engagement and release of said bag for punches, kicks and boxing.

4. The bag for punches, kicks and boxing, for suspension, according to claim 1, consisting of said at least three full cylinders made of concrete, the spaced discs of polyurethane, and the coatings of polyurethane, where ends of the coatings of said spine are provided in said bag by the top layer of agglomerated polyurethane foam disc, and by the bottom layer of agglomerated polyurethane foam disc, and, configured to allow said bag to absorb punches or kicks, struck by the user in training, and react similarly to an opponent human body, of various sizes.

* * * * *